United States Patent [19]

Hicks

[11] 4,454,966

[45] Jun. 19, 1984

[54] AEROSOL DISPENSER CASE

[76] Inventor: Sonja L. Hicks, 3608 Springbrook, Dallas, Tex. 75205

[21] Appl. No.: 325,284

[22] Filed: Nov. 27, 1981

[51] Int. Cl.[3] ..... B67B 5/00

[52] U.S. Cl. ..... 222/153; 222/173; 222/182; 222/402.11

[58] Field of Search ..... 222/394, 402.1, 402.11, 222/402.13, 153, 173, 183, 402.15, 182; 239/289, 337, 537

[56] References Cited

U.S. PATENT DOCUMENTS

| | | | |
|---|---|---|---|
| 3,445,046 | 5/1969 | Wilson | 239/337 X |
| 3,608,791 | 9/1971 | Jordan et al. | 222/402.11 |
| 3,848,778 | 11/1974 | Meshberg | 222/402.11 |
| 4,220,263 | 9/1980 | Caruso | 222/183 |

*Primary Examiner*—Joseph J. Rolla
*Assistant Examiner*—Thomas C. Fitzgerald
*Attorney, Agent, or Firm*—Hubbard, Thurman, Turner & Tucker

[57] ABSTRACT

A case for enclosing an aerosol dispenser is disclosed. The case is constructed of a semi-rigid material and conforms generally to the form of the aerosol dispenser. The uppermost portion of the case is designed to conform particularly to the actuator portion of a selected aerosol dispenser and together with an aperture disposed in the area of the aerosol nozzle, permits operation of the aerosol dispenser while the dispenser is contained within the case. In one embodiment the case includes a ring for attaching keys to the body of the case.

4 Claims, 2 Drawing Figures

AEROSOL DISPENSER CASE

BACKGROUND OF THE INVENTION

This invention relates to aerosol dispenser cases in general and in particular to cases which permit actuation of an aerosol dispenser which is disposed within the case.

An increasing number of personal products are available to the consumer which are packaged within small aerosol containers and which are dispensed by means of actuating the aerosol container. Examples of such products include: perfume; cologne; breath freshener; insect repellents; hair spray and personal defense products such as orthochlorobensolmalononitrile (commonly known as tear gas).

A problem arises in the area of personal defense products wherein it is desirable to provide a case or container which will permit the consumer to carry such aerosol dispensers in an inconspicuous manner and yet will permit actuation of an aerosol dispenser with a minimal amount of notice. At least one such case is currently available to the consumer and is described as a "holster." This known case permits the unobtrusive possession of a personal defense aerosol product; however, the case may require that the aerosol dispenser be removed from the holster to be safely utilized. Given the small amount of advance notice frequently available to the consumer prior to the need for the utilization of such a personal defense product, such a case may preclude the rapid and safe operation of the aerosol dispenser.

SUMMARY OF THE INVENTION

It is therefore one object of the present invention to provide an improved aerosol dispenser case.

It is another object of the present invention to provide an improved aerosol dispenser case which permits rapid actuation of the aerosol dispenser while the aerosol dispenser is disposed within the case.

It is yet another object of the present invention to provide an improved aerosol dispenser case which may be easily and unobtrusively carried by the consumer.

The foregoing objects are achieved as is now described. A case is provided which is constructed of a semi-rigid material such as leather, vinyl or plastic. The uppermost portion of the case is designed specifically to conform to the actuator portion of a selected aerosol dispenser and together with an aperture within the case, disposed in the area of the aerosol nozzle, permits actuation of the aerosol dispenser while the dispenser is disposed within the case. In a preferred embodiment, the case includes means for attaching at least one key to the bottom surface of the case, thereby facilitating consumer use while entering or leaving a residence or automobile.

BRIEF DESCRIPTION OF THE DRAWINGS

The novel features believed characteristic of the invention are set forth in the appended claims. The invention itself; however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
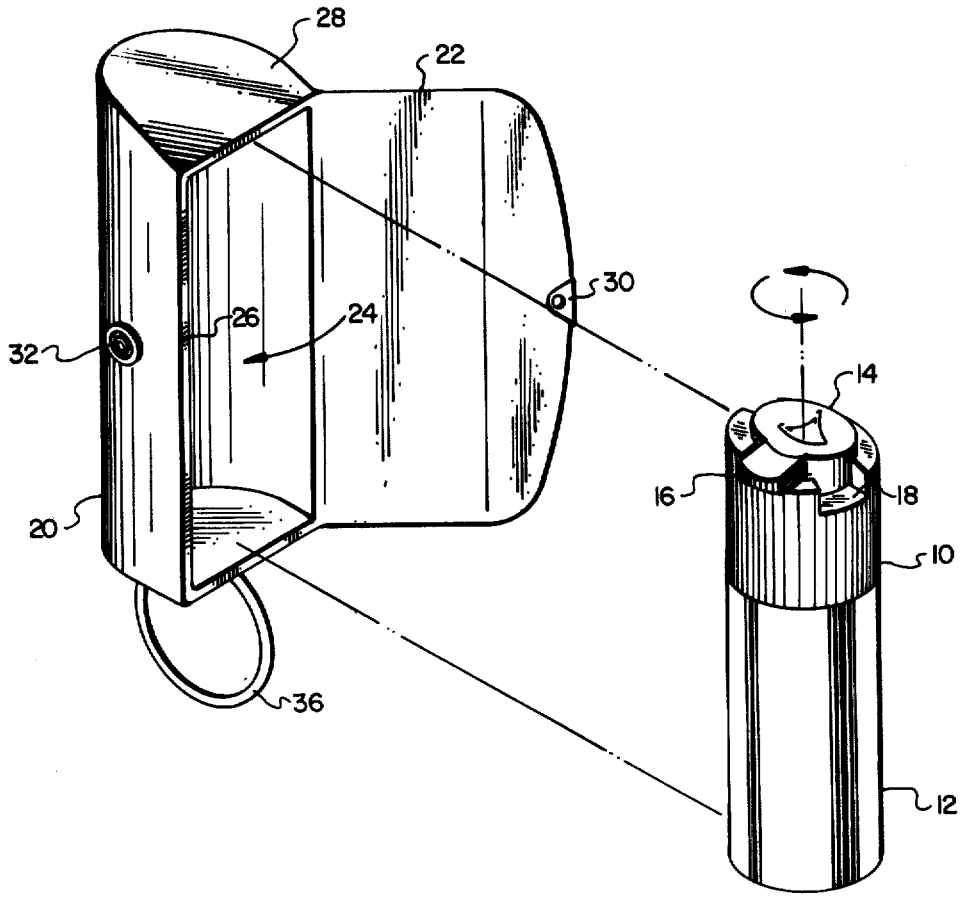
FIG. 1 is an exploded perspective view of the aerosol dispenser case of the present invention with an aerosol dispenser.

With reference now to the figures, and in particular with reference to FIG. 1, there is depicted an exploded perspective view of the aerosol dispenser case of the present invention, with an aerosol dispenser disposed therein.

Aerosol dispenser 10 includes a canister 12 and an actuator surface 14. In the particular embodiment depicted, actuator surface 14 includes an interlock tab 16 which precludes operation of aerosol dispenser 10 while disposed in the position depicted. A counterclockwise rotation of actuator surface 14 will result in interlock tab 16 rotating to a position above slot 18. While positioned above slot 18, interlock tab 16 will move vertically and permit operation of actuator surface 14, and thus aerosol dispenser 10.

Aerosol dispenser case 20 includes a movable flap 22 and an aperture 24. Aperture 24 is adapted to receive aerosol dispenser 10 and is constructed to specific dimensions which permit interaction with interlock tab 16, as discussed herein.

As aerosol dispenser 10 is inserted into aperture 24, interlock tab 16 will strike edge 26 of aperture 24. Further insertion into aperture 24 will cause interlock tab 16 to rotate to the operating position above slot 18. Once completely inserted into aperture 24, aerosol dispenser 10 is held in a fixed position by the incline of top surface 28, which is designed to match the incline of actuator surface 14. Top surface 28 is constructed of a flexible membrane type material such as vinyl, plastic or leather.

Aerosol dispenser case 20 also includes a fastening means to retain aerosol dispenser 10 within aperture 24. The fastening means depicted in FIG. 1 is comprised of a male member 30 mounted on movable flap 22 and female member 32. Aerosol dispenser case 20 also includes, in a preferred embodiment, key ring 36, which permits the mounting of one or more keys on aerosol dispenser case 20. In a preferred utilization with a personal defense product such as tear gas, the utilization of key ring 34 will permit rapid access to the personal defense product by a consumer during entry or departure to or from a residence or automobile.

Figure 2:
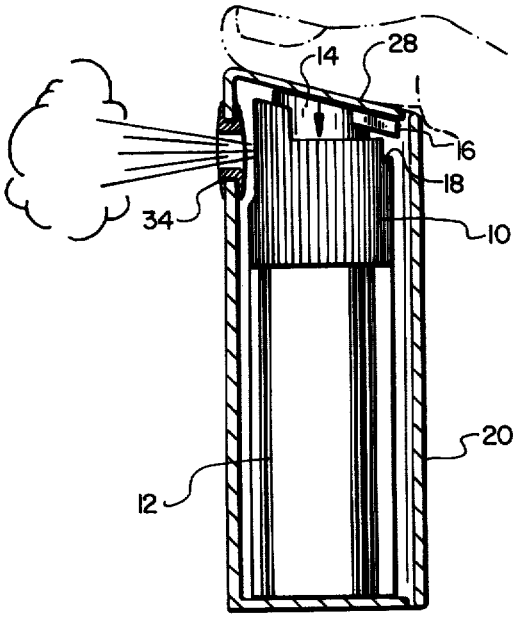
FIG. 2 is a sectional view of the aerosol dispenser case of the present invention.

Referring now to FIG. 2, there is depicted a sectional view of the aerosol dispenser case 20 of the present invention. Aerosol dispenser 10 is depicted within aerosol dispenser case 20 with the nozzle (not shown) disposed adjacent to aperture 34. Aperture 34 is, in the disclosed embodiment, a metallic grommet of sufficient interior diameter to permit wide dispersement of the aerosol product contained within aerosol dispenser 10.

Top surface 28 is depicted as inclined and parallel to the inclined surface of actuator surface 14. Top surface 28, as discussed above, is comprised of a flexible membrane-like material and is designed to conform specifically to the actuator surface of the aerosol dispenser. The conformity of top surface 28 with actuator surface 14 permits the rapid and reliable operation of aerosol dispenser 10 while aerosol dispenser 10 is disposed within aerosol dispenser case 20. Further, the close conformity of top surface 28 with actuator surface 14 will ensure that the nozzle of aerosol dispenser 10 is always disposed adjacent to aperture 34 by precluding the rotation of aerosol dispenser 10 while aerosol dispenser 10 is disposed within case 20. Thus, unlike known aerosol dispenser cases, aerosol dispenser case 20 of the present invention permits safe, reliable operation of the aerosol dispenser 10 by ensuring that dispersement of the aerosol product always occurs in a known direction relative to aerosol dispenser case 20. Those skilled in the art will appreciate that the utilization of alternate aerosol dispensers, with various shapes and configurations to their individual actuator surfaces, will be possible with the aerosol dispenser case of the present invention upon a slight modification to the design of top surface 28.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

What is claimed is:

1. An aerosol dispenser case adapted to receive an aerosol dispenser having a nozzle and an actuator surface, said actuator surface comprising a rotatable inclined surface adapted to preclude operation of said aerosol dispenser while disposed in a first position and adapted to permit operation of said aerosol dispenser while disposed in a second position, said case comprising:

a generally tube-shaped container having a bottom surface and a top surface conforming generally to the form of said aerosol dispenser;

a first aperture disposed in a side of said tube-shaped container for receiving said aerosol dispenser;

means for rotating said actuator surface from said first position to said second position upon insertion of said aerosol dispenser into said first aperture; and a second aperture within said container disposed adjoining to said nozzle of said aerosol dispenser, wherein said top surface comprises a flexible membrane conforming substantially to and inclined parallel with said actuator surface and adapted to permit actuation of said aerosol dispenser while said aerosol dispenser is disposed within said container.

2. The aerosol dispenser case according to claim 1 wherein said bottom surface includes means for attaching at least one key.

3. The aerosol dispenser case according to claim 1 wherein said second aperture comprises a metallic grommet.

4. The aerosol dispenser case according to claim 1 wherein said container is constructed of vinyl.

* * * * *